United States Patent [19]

Plantureux

[11] 4,198,909

[45] Apr. 22, 1980

[54] TRACK BRAKE FOR RAILWAYS

[75] Inventor: Jean Plantureux, Paris, France

[73] Assignee: Faiveley S.A., Seine-Saint-Denis, France; a part interest

[21] Appl. No.: 858,083

[22] Filed: Dec. 6, 1977

[30] Foreign Application Priority Data

Dec. 16, 1976 [FR] France ..... 76 37900
Nov. 17, 1977 [FR] France ..... 77 34629

[51] Int. Cl.[2] ..... B61K 7/02; B61B 1/00

[52] U.S. Cl. ..... 104/26 A; 74/110; 188/38.5; 188/62; 246/182 A

[58] Field of Search ..... 104/26 R, 26 A, 162; 246/182 A, 182 BH; 188/62, 38.5; 74/110

[56] References Cited

U.S. PATENT DOCUMENTS

| | | | |
|---|---|---|---|
| 1,766,539 | 6/1930 | Prescott | 104/26 A X |
| 1,990,521 | 2/1935 | Bone | 246/182 A |
| 2,588,798 | 3/1952 | Bone et al. | 188/62 X |
| 2,679,809 | 6/1954 | Beltman et al. | 104/26 A |
| 3,128,721 | 4/1964 | McGowan | 104/162 |
| 3,360,304 | 12/1967 | Adams et al. | 246/182 A X |
| 3,410,224 | 11/1968 | Escott | 104/162 |
| 3,637,052 | 1/1972 | Bick | 188/62 |

FOREIGN PATENT DOCUMENTS

| | | | |
|---|---|---|---|
| 608663 | 11/1960 | Canada | 188/62 |
| 1937113 | 2/1971 | Fed. Rep. of Germany | 104/26 A |

OTHER PUBLICATIONS

Federico Strasser, "10 Ways to Change Straight-Line Direction," *Product Engineering*, Feb. 29, 1960, pp. 61, 63.

*Primary Examiner*—Randolph A. Reese
*Attorney, Agent, or Firm*—Young & Thompson

[57] ABSTRACT

The track brake is intended to limit the speed of rolling motion of a freight car according to the track gradient in a marshalling yard. A retarder installed along a braking rail comprises a number of braking tappets each having a portion which projects above the braking rail in the rest position and each being applied in turn beneath each wheel of the car to be braked. The track brake comprises a motion converter constituted by a series of rockers each pivotally mounted on a pin connected to the braking rail. One portion of each rocker cooperates with a braking tappet and another portion of the rocker cooperates with a piston-rod of a substantially horizontal hydraulic brake cylinder.

8 Claims, 22 Drawing Figures

TRACK BRAKE FOR RAILWAYS

This invention relates to a railway track brake for limiting the speed of rolling motion of a freight car according to the gradient of a shunting track laid on crossties or sleepers having standardized spacing. The above-mentioned track brake comprises retarding means installed in the service position along one rail of the track in order to produce action successively on each wheel of the freight car.

A number of different designs of track brakes of the type mentioned above are already known. For example, a typical brake unit comprises a vertical hydraulic cylinder which is embedded in the track ballast and the upper end of which is secured to the rail. A piston slidably mounted within the cylinder is urged by a restoring spring towards a rest position in such a manner as to ensure that a braking push-button or tappet associated with the piston projects above the level of the top portion of the rail in the rest position aforesaid. The tappet can thus be successively applied beneath each freight-car wheel in order to produce a brake application as it is displaced downwards beneath each wheel.

It is thus sought to maintain the speed of rolling motion of the car below a predetermined value equal to 1.5 meter per second, for example, which is the maximum value permitted for the impact of one car against another car which is already stopped on the track.

In point of fact, modern freight cars usually have an excellent coefficient of rolling motion, with the result that they can maintain their speed on shunting tracks having a gradient of only 1/1000 or 1.5/1000, for example. However, the usual gradient of existing marshalling yards is of the order of 3/1000 on an average, in order to ensure a running speed of at least 0.8 m/s, for example, in the case of older types of cars which have a low coefficient of rolling motion.

The speed at which modern cars travel on shunting tracks thus tends to become rapidly excessive. In order to produce automatic brake action on these cars and thus to meet the requirements of current design trends in modern marshalling yards, it would be necessary to employ a large number of brake units and to place them close to each other, taking into account the possible dimensions of each brake unit as well as the energy absorption which is permitted without any attendant danger of derailment of the car. An installation of this type is difficult and costly to construct.

The aim of the invention is to overcome the difficulties mentioned in the foregoing and to permit the construction of a track brake which is both efficient and convenient to install so that the speed of a freight car having a good coefficient of rolling motion can be controlled automatically along a shunting track.

The invention is directed to a railway track brake for limiting the speed of rolling motion of a car according to the gradient of a shunting track. The brake is provided with retarding means installed in the service position along a braking rail of the track; the retarding means comprise a predetermined number of braking tappets having in the rest position an upwardly projecting portion relatively to the level of the top portion of the braking rail in order to be successively applied beneath each wheel of the car; the braking tappets are associated with hydraulic brake cylinders each provided with a piston, the piston-rod connected to a braking tappet being subjected to the action of a restoring spring for urging the tappet towards its rest position.

In accordance with the invention, the aforementioned brake essentially comprises a motion converter constituted by a series of motion-transmission rockers each having a shaft attached to the braking rail, one portion of each rocker being adapted to cooperate with a braking tappet and another portion of said rocker being adapted to cooperate in a direction transverse to the braking rail with a piston-rod of a substantially horizontal hydraulic brake cylinder.

As will be explained in the following description, the motion converter which is thus constituted by successive rockers permits an advantageous distribution of the retarding functions over a predetermined length of the braking rail. The horizontal arrangement of each brake cylinder which is oriented transversely to the braking rail nevertheless makes it possible to limit the overall dimensions of the retarding means in the direction of the length of the braking rail. Similarly, the overall height of the brake unit is accordingly reduced, thus permitting a lateral installation of the brake unit without any need for laborious excavations of the subjacent ballast. Preferably, in the case of a track laid on crossties or sleepers having standardized spacing, the track brake in accordance with the invention constitutes a modular unit which is adapted to the spacing of the crossties; the retarding means are disposed along the braking rail over a distance which is equal at a maximum to the interval between the wheels of one bogie of the freight car.

The track brake constituting a modular unit adapted to the spacing of crossties can be laid both easily and economically, especially in a marshalling yard which has a large number of track brakes placed on parallel tracks and to which the invention is specially directed. The overall longitudinal dimensions of the retarding means limited to the interval between the wheels of one car bogie makes it possible to provide an efficient and accurate brake unit which can be precisely adpated to the weight of each wheel to be braked as will be explained hereinafter.

As an advantageous feature, each braking tappet comprises a horseshoe body having two substantially parallel arms and slidably mounted in guides which are rigidly fixed to the braking rail; a profiled top portion of the tappet body which joins the two arms to each other is located above the level of the top face of the braking rail when said top portion is in the rest position. Preferably, the profiled top portion of the braking tappet is provided with a bearing face having a substantially constant slope in the direction of motion of the car to be braked.

As will be explained in the following description, the horseshoe tappet system permits strong and rugged industrial manufacture of the brake unit in accordance with the invention. The substantially constant slope of the bearing face of the braking tappet ensures uniform downward displacement of the tappet as each car wheel passes.

By way of alternative, the guides which are rigidly fixed to the braking rail are substantially perpendicular to the constant-slope bearing face of the braking tappet; the pivot-pin of the motion-transmission rocker associated with the braking tappet is substantially parallel to the bearing face aforesaid.

The orientation of the guides at right angles to the bearing face of the braking tappet prevents undesirable lateral components of the horseshoe body within the guides at the moment when the wheel to be braked comes into contact with the bearing face. A long period of service life is thus ensured without any effect of jamming of the mechanism of the braking tappet.

As an advantageous feature in the case of a track brake comprising a wheel-weighing tappet which controls a brake-application regulator associated with each hydraulic brake cylinder, the bearing face of the weighing tappet is substantially flat and parallel to the top portion of the adjacent rail and to the pivot-pin of the associated rocker. Preferably, the top portion of the braking rail is provided opposite to the weighing tappet with a shaped recess below the level of the top face of the remainder of the braking rail; in the rest position, the bearing face of the weighing tappet is substantially at the same height as the level aforesaid.

The foregoing arrangements have the effect of ensuring a very substantial reduction in dynamic stresses in the vertical direction at the time of passage of each wheel to be weighed, thereby achieving enhanced efficiency of the track brake, the adjustment of which is thus ensured by means of the weighing tappet in an accurate manner.

In the case of a track brake comprising a certain number of motion-transmission rockers each having a pivot-pin rigidly fixed to the braking rail and contained in a plane parallel to this latter, each tappet advantageously forms part of the rocker aforesaid in order to constitute a radial projection with respect to the pivot-pin of said rocker, a profiled bearing face being provided at the top of said radial projection in order to cooperate with each wheel of the car to be braked.

As will be explained in the following description in connection with an industrial embodiment of the invention, the combination of the tappet and the motion-transmission rocker in a single component permits an economical reduction in the number of brake components as well as rugged and compact manufacture of the track brake.

Preferably, the pivot-pin of each rocker is supported by brackets mounted on substantially vertical partitions arranged transversely to the braking rail; the partitions aforesaid are substantially parallel and rigidly fixed to a common bed-plate provided with fastening means for mounting said bed-plate on the crossties of the track. As an advantageous feature, the bed-plate and the partitions aforesaid constitute a substantially leak-tight casing for the brake mechanisms.

The casing which is thus constituted for example by sheet-metal elements of substantial thickness assembled together by welding permits industrial manufacture of a track brake in accordance with the invention and in the form of a unit which offers a long service life and has a small overall size.

Further distinctive features and advantages of the invention will become apparent from the following description of a few embodiments which are presented hereinafter by way of example without any limitation being implied, reference being made to the accompanying drawings, wherein.

Figure 1:
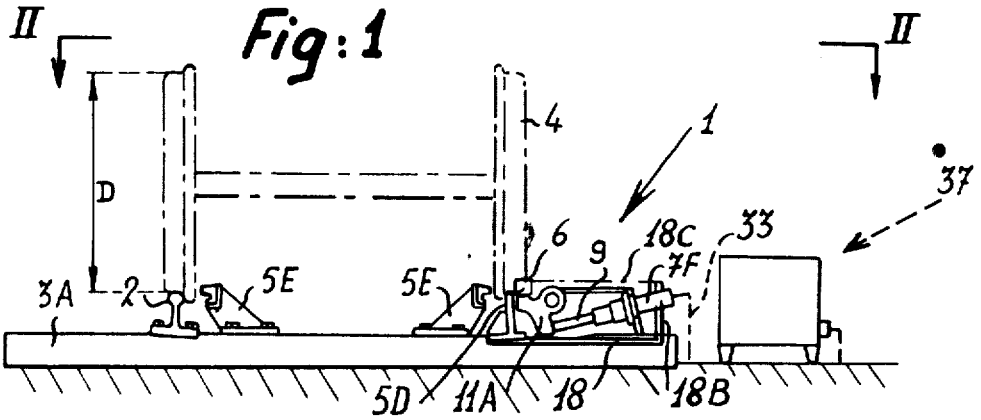
FIG. 1 is a diagrammatic transverse sectional view of a track brake in accordance with the invention, this view being taken along line I—I of FIG. 2.
Figure 2:
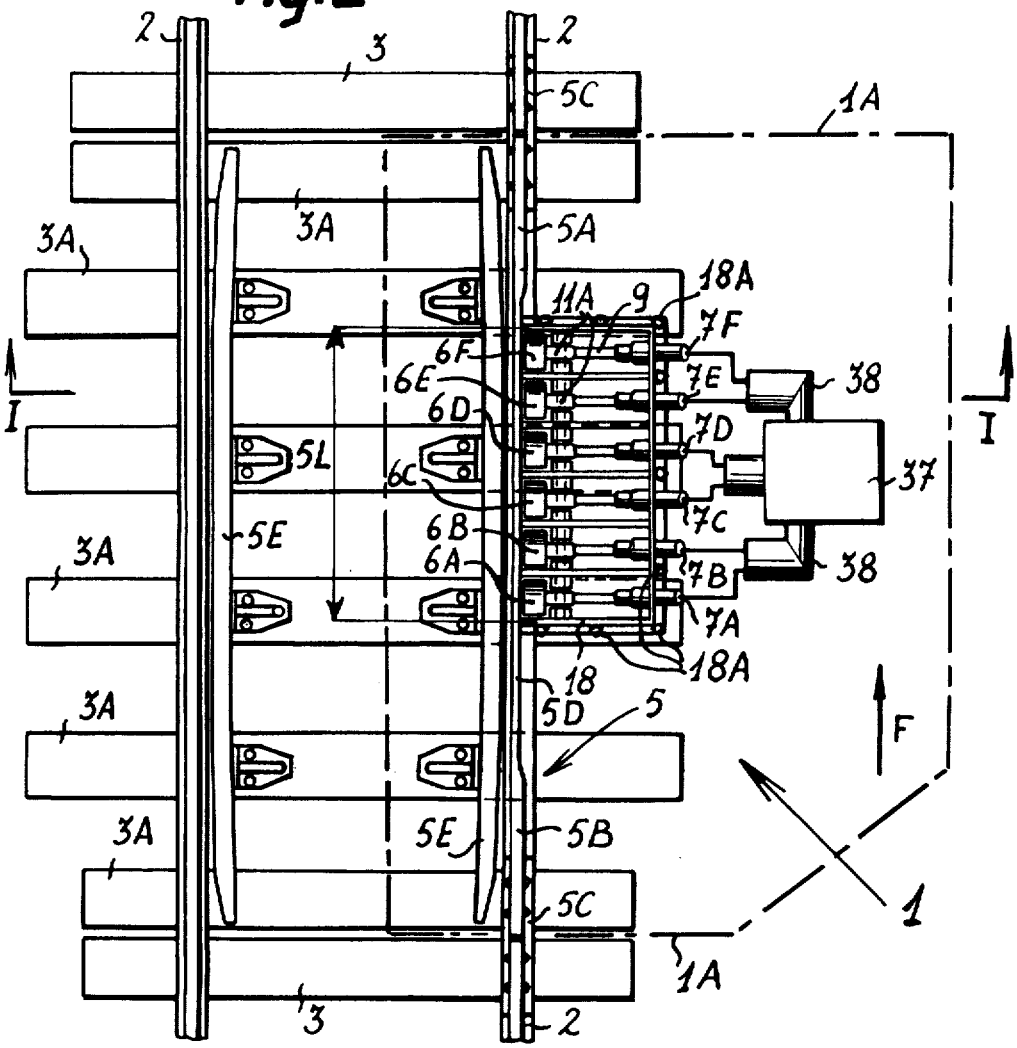
FIG. 2 is a plan view of the same track brake, this view being taken along line II—II of FIG. 1.
Figure 6:
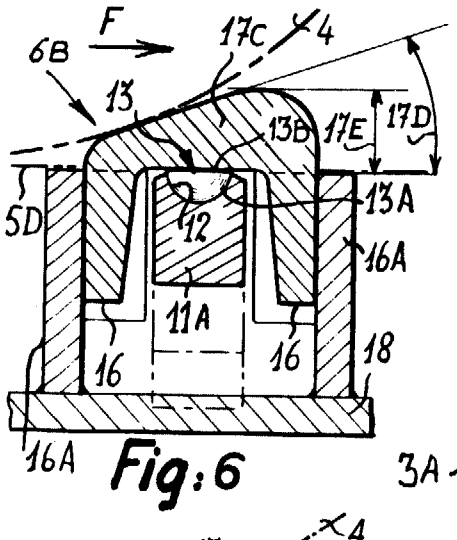
Figure 5:
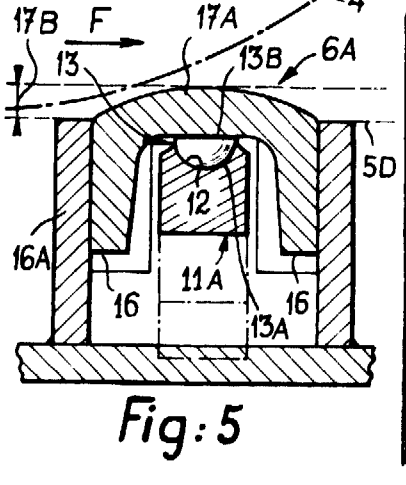
FIG. 5 is a sectional view of FIG. 3 along the line V—V and illustrates the vertical-motion weighing tappet of the track brake.
Figure 7:
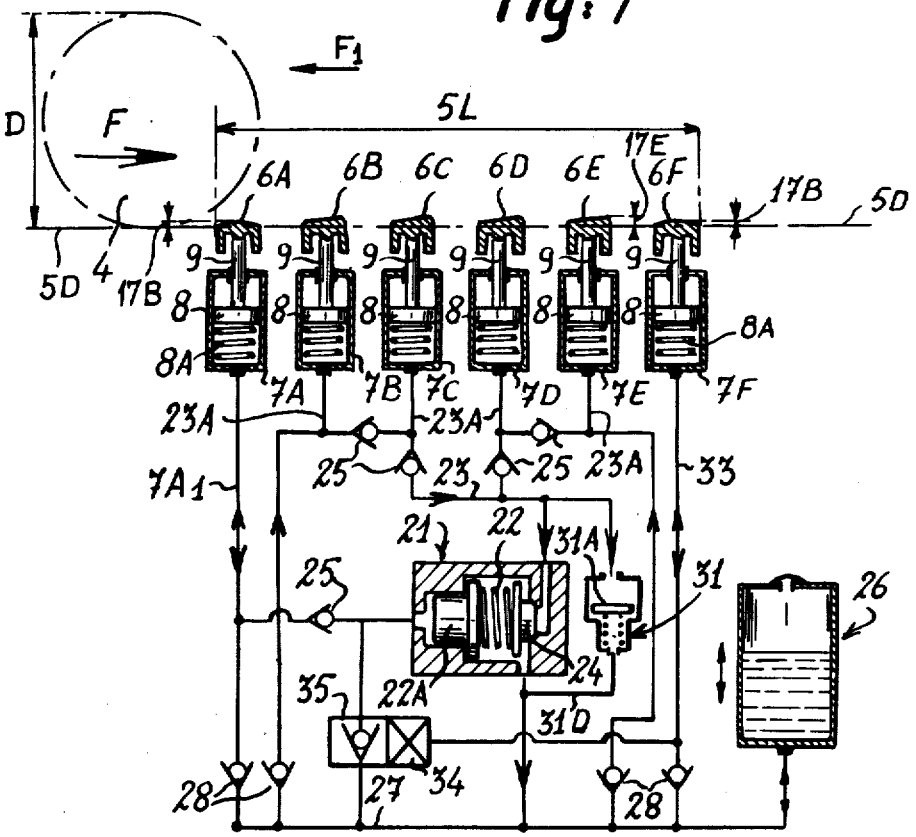
Figure 8:
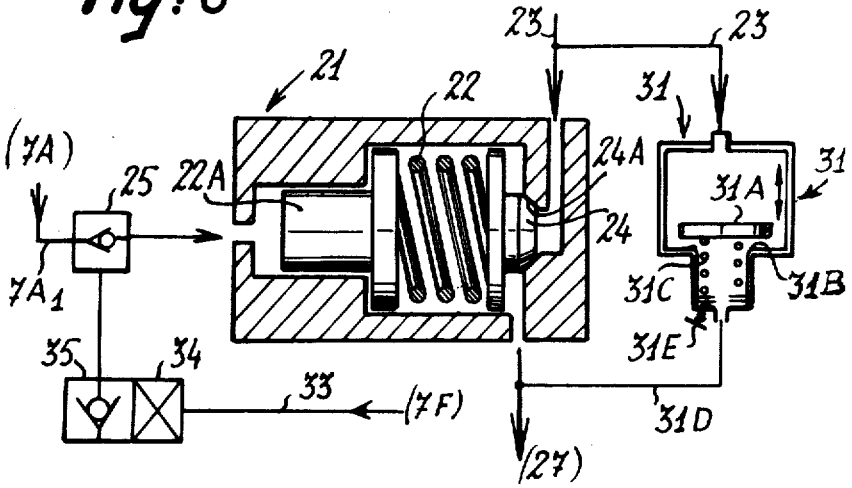
Figure 9:
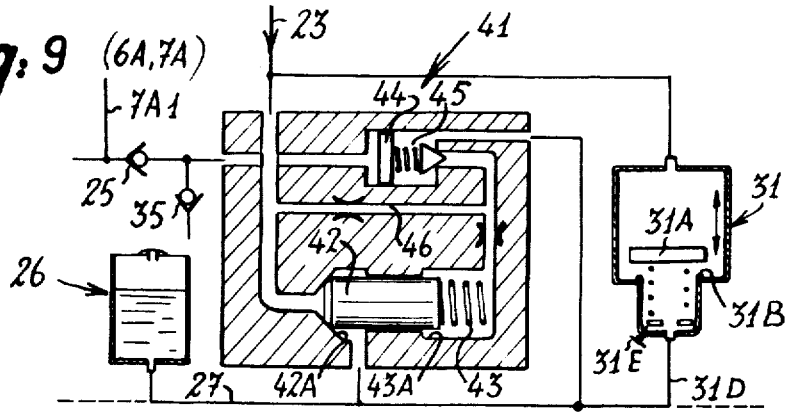
Figure 10:
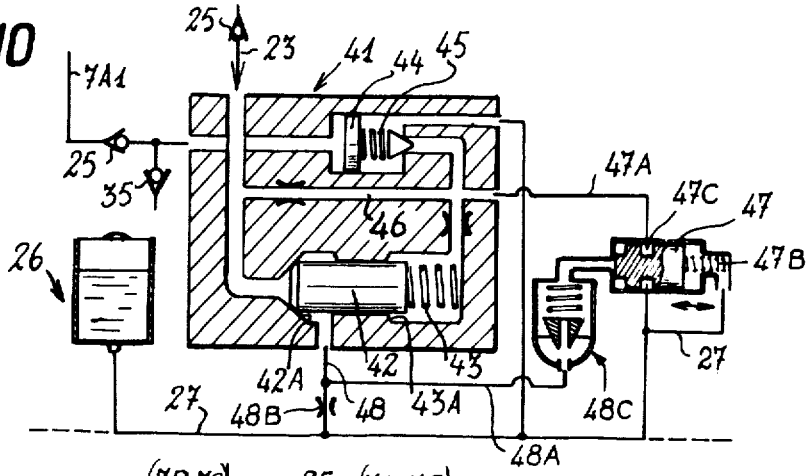
Figure 13:
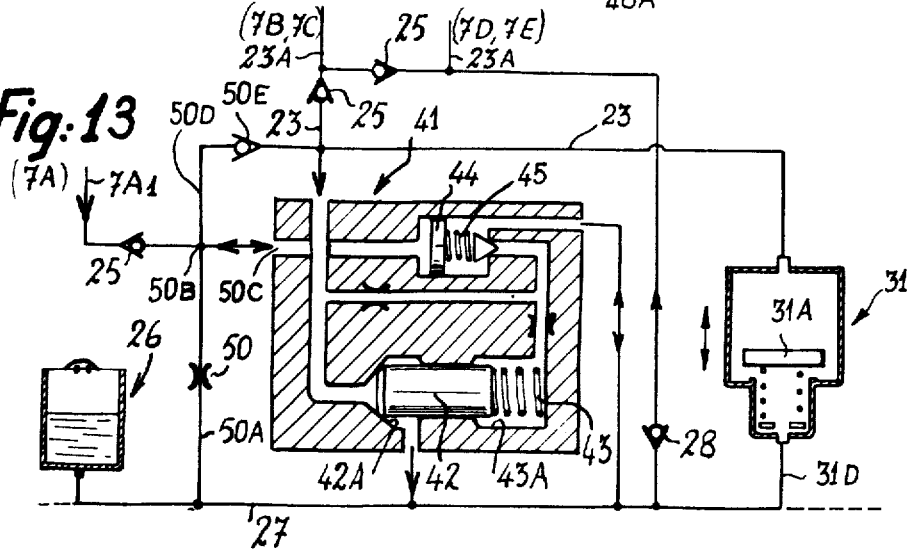
Figure 11:
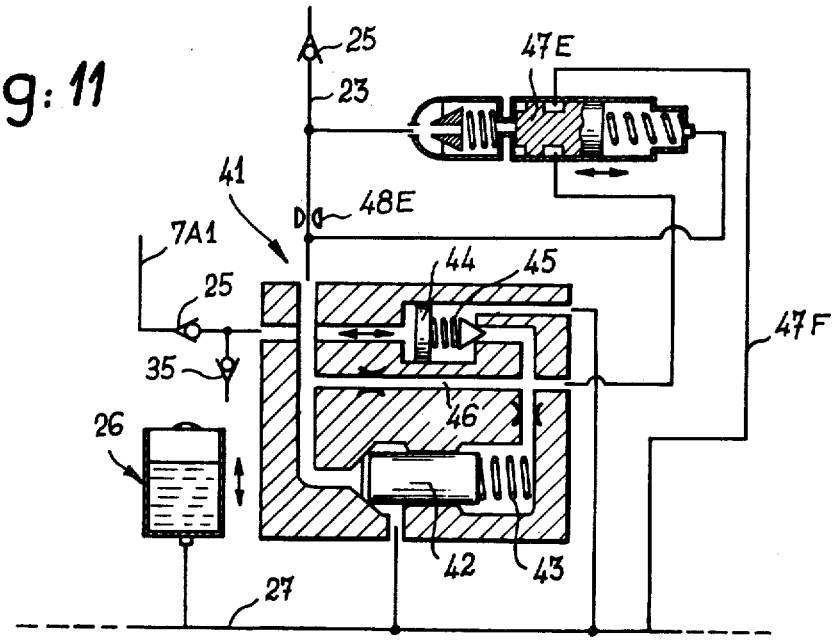
Figure 12:
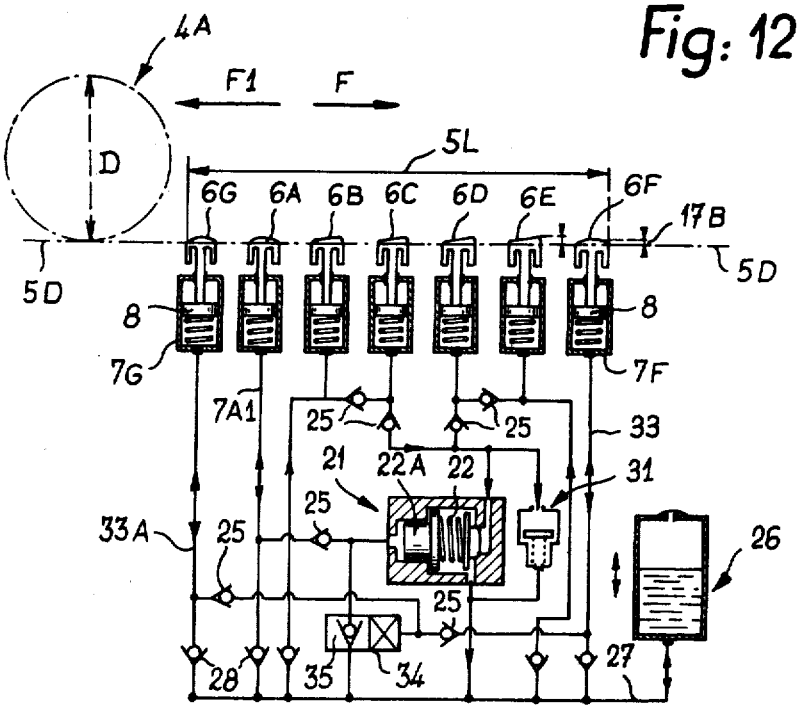
Figure 14:
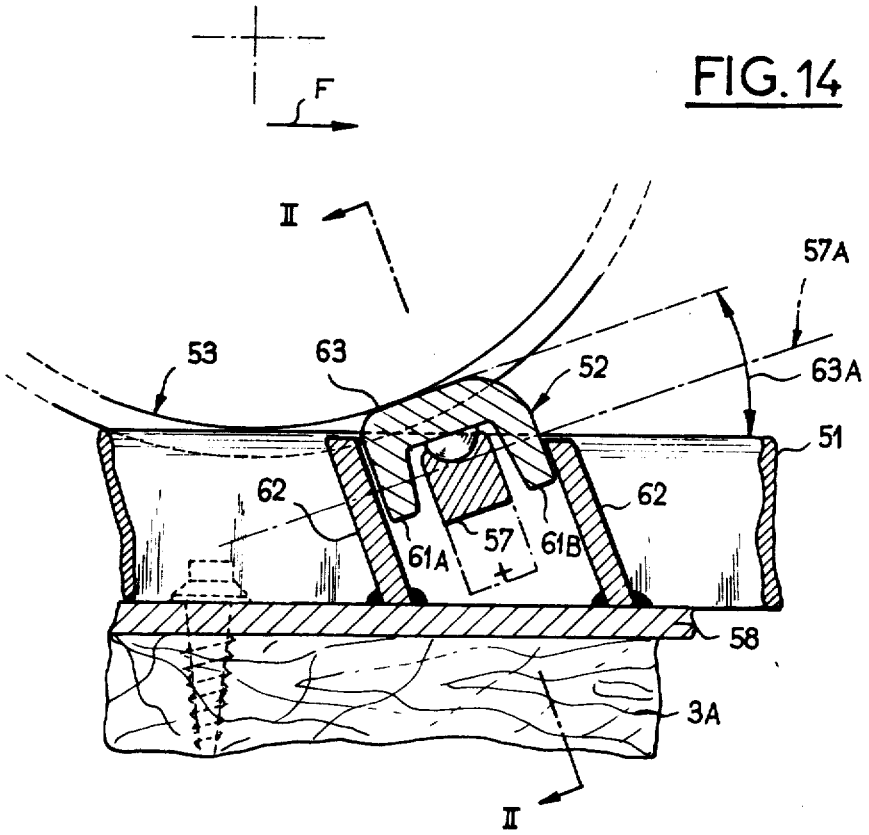
Figure 15:
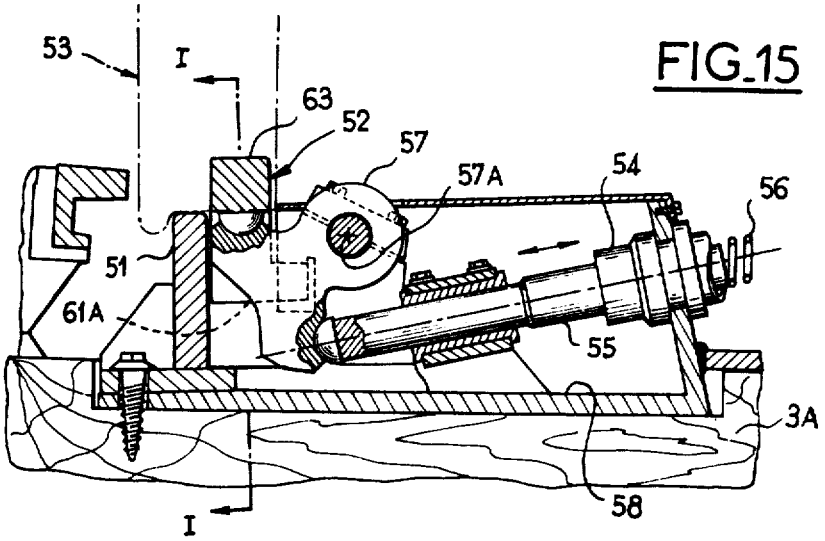
Figure 16:
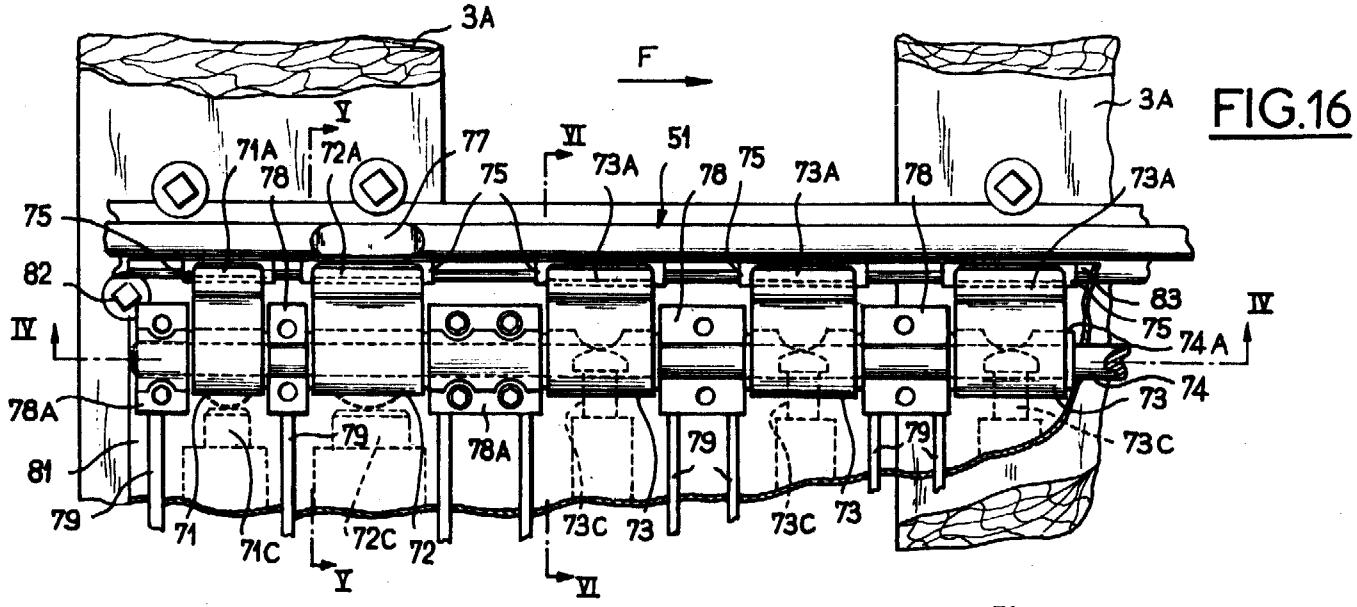
Figure 17:
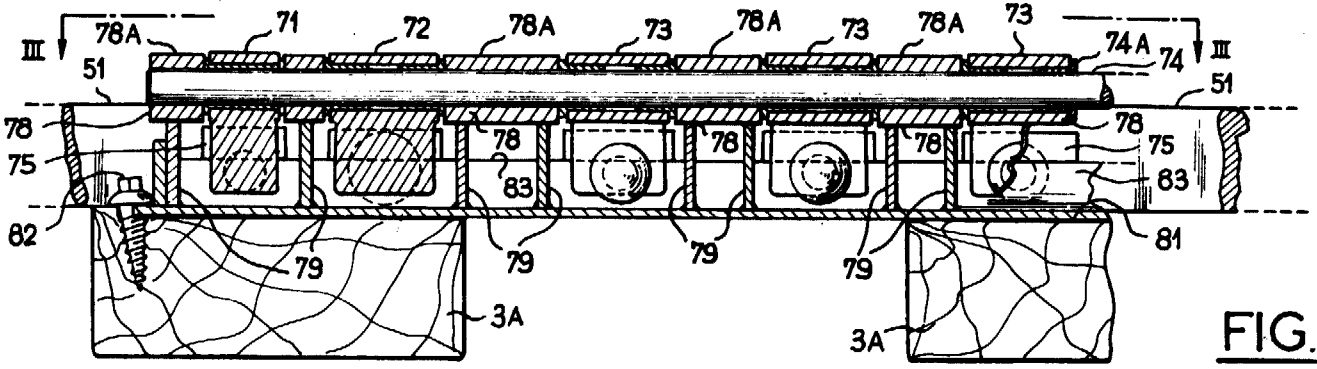
Figure 19:
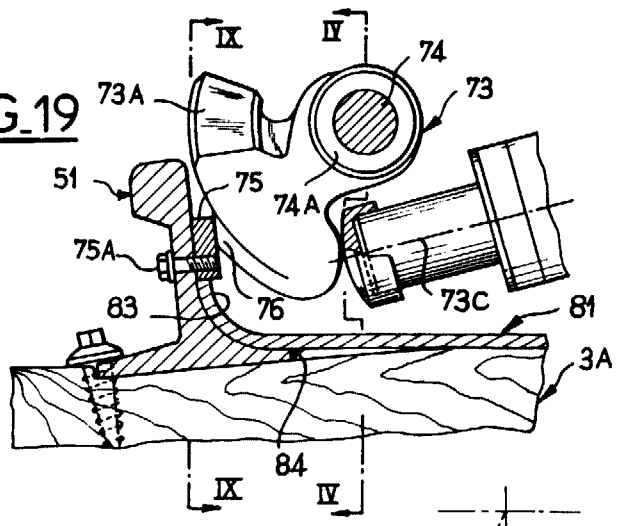
Figure 18:
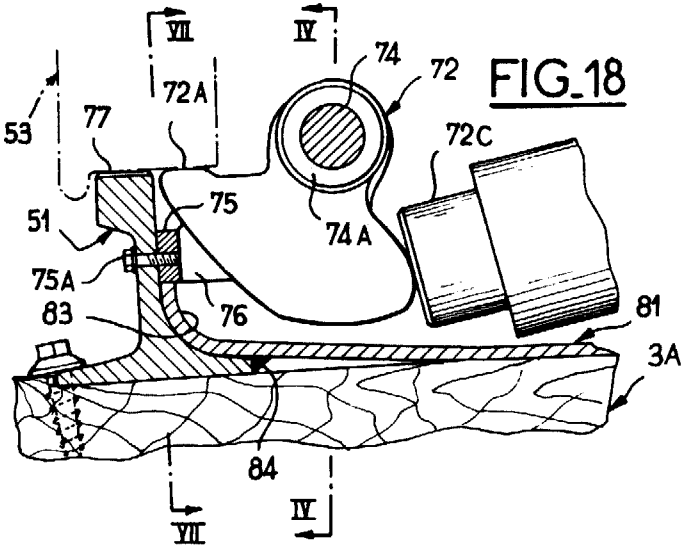
Figure 22:
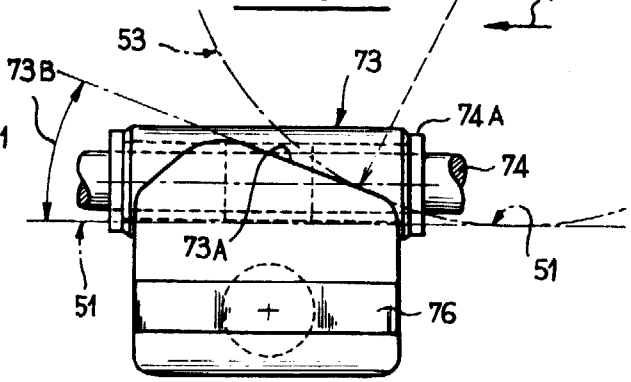
Figure 20:
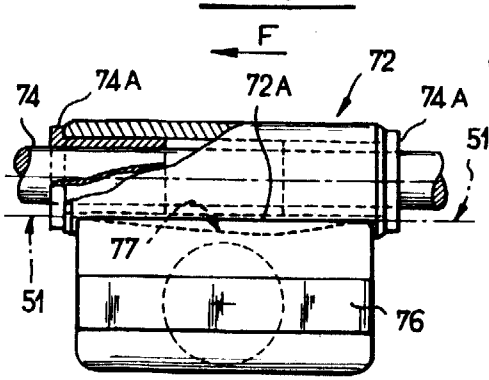
Figure 21:
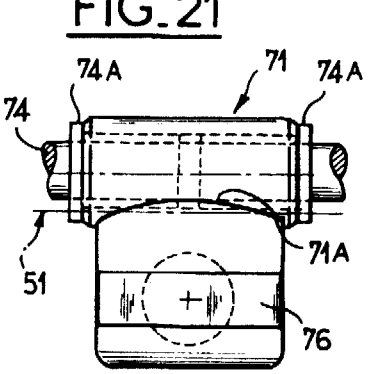

FIG. 6, which is similar to FIG. 5, illustrates a braking tappet of the track brake which is placed after the weighing tappet;

FIG. 7 is a general diagram of the hydraulic circuits of the track brake shown in FIGS. 1 and 2;

FIG. 8 is an enlarged diagrammatic view of the brake-application regulator and of the flow-threshold valve shown in FIG. 7;

FIG. 9, which is similar to FIG. 8, shows diagrammatically an alternative form of the brake-application regulator of the track brake in accordance with the invention, said regulator being provided with a pilot piston for controlling the throttling piston;

FIG. 10 is a diagram of an alternative form of the brake-application regulator of FIG. 9, in which the threshold valved mounted as a by-pass is replaced by a controlled slide-valve;

FIG. 11, which is similar to FIG. 10, shows another mode of assembly of the controlled slide-valve which is mounted as a by-pass off the throttling piston;

FIG. 12, which is similar to FIG. 7, shows a further alternative form of the track brake in accordance with the invention and comprising an additional clearing tappet;

FIG. 13, which is similar to FIG. 9, illustrates the braking regulator which is associated with an automatic-clearing circuit having a calibrated-leakage orifice;

FIG. 14 is a diagrammatic longitudinal sectional view of a braking tappet in accordance with a first improvement, this view being taken along line I—I of FIG. 15;

FIG. 15 is an oblique sectional view of FIG. 14, this view being taken along line II—II in a transverse direction with respect to the braking rail, there being shown in this figure the rocker and the hydraulic piston which are associated with the braking tappet;

FIG. 16 is a diagrammatic overhead plan view taken along line III—III of FIG. 17 and showing a track brake comprising a series of rockers in accordance with a second improvement;

FIG. 17 is a vertical sectional view of FIG. 16 which is taken along line IV—IV and shows the articulation of the rockers on a common shaft;

FIG. 18 is a diagrammatic transverse sectional view of FIG. 16 which is taken along line V—V and shows the weighing rocker associated with its hydraulic piston;

FIG. 19, which is similar to FIG. 18, is a transverse sectional view of FIG. 16 which is taken along line VI—VI and shows a braking rocker associated with its hydraulic piston;

FIG. 20 is a front view of the weighing rocker, this view being taken along line VII—VII of FIG. 18;

FIG. 21, which is similar to FIG. 20, is a front view of the clearing rocker;

FIG. 22, which is similar to FIGS. 20 and 21, is a front view of the braking rocker of FIG. 19, this view being taken along line IX—IX.

In the embodiment of FIGS. 1 to 8, the track brake 1 for railways is intended to limit the speed of rolling motion of a freight car (not shown) according to the gradient of a shunting track having two parallel rails 2 laid on standard-spacing crossties or sleepers 3. The track brake 1 comprises retarding means described hereinafter which are installed in the service position along one rail 2 of the track in order to produce action successively on each wheel 4 of the freight car.

In accordance with the invention, the track brake 1 constitutes a modular unit which is delimited diagrammatically by a chain-dotted line 1A in FIG. 2. The modular unit of the track brake 1 is adapted to the spacing of the track crossties 3 and comprises at least one braking rail section 5 which is removably mounted in the service position in place of an ordinary rail section 2 of the track. The retarding means described hereinafter are placed next to the braking rail section 5 over a limited length 5L (FIGS. 2 and 7) which is shorter than the interval between the wheels 4 of one of the car bogies (not shown). By way of example, this interval is equal to 1.80 meter.

Figure 3:
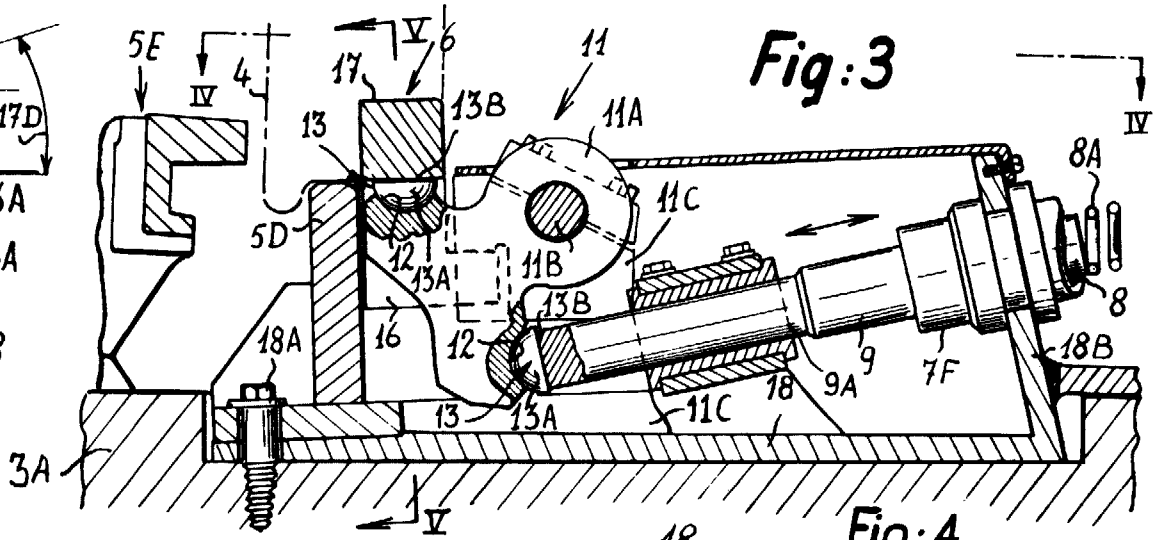
FIG. 3 is an enlarged view of a portion of FIG. 1 showning the braking rail and the vertical-motion tappet associated by the motion converter with the substantially horizontal hydraulic brake cylinder.

Preferably, the braking rail section 5 and the intermediate portion of the other rail 2 are both associated with a check-rail 5E in order to improve the guiding action of the car wheels 4 in the zone of action of the track brake 1 (as shown in FIGS. 1 to 3).

As an advantageous feature which is illustrated in FIG. 2, the braking rail section 5 is provided at its two end portions 5A, 5B with a profile which is substantially identical with the profile of the ordinary rails 2 of the adjacent track in order to connect the braking rail section 5 to these latter, for example by means of bolted fishplates 5C. The zone 5D of the braking rail section which is located between the two above-mentioned end portions 5A, 5B is provided in the upper portion thereof with a profile of reduced thickness (as shown in FIGS. 1 and 3) for the lateral mounting of a vertical-motion tappet 6. In the rest position shown in FIGS. 3 and 5, said tappet has a portion which projects above the level of the top face of the braking rail 5 in order to be applied successively beneath each freight-car wheel 4.

The retarding means of the track brake comprise a series of hydraulic cylinders 7A, 7B, 7C, etc. (as shown in FIG. 2). There is slidably mounted within each cylinder 7 a piston 8 (FIG. 3) associated with a restoring spring 8A which urges the piston 8 towards its rest position. Said piston has a rod 9 connected to a vertical-motion tappet 6A, 6B, 6C etc. by means of a motion converter 11 comprising a rocker 11A mounted on a pivot-pin 11B which is rigidly fixed to the braking rail section 5 by means of a support structure as will be described hereinafter. The pivot-pin 11B of each rocker 11A is secured to the structure aforesaid by means of a support bracket 11C (shown in FIGS. 3 and 4), the axis of said pivot-pin being substantially horizontal and parallel to the braking rail section 5D. The rocker 11A has a portion which cooperates with the vertical-motion tappet 6 and another portion which cooperates with the rod 9 of the piston 8 of the horizontal cylinder 7 which is oriented transversely with respect to the rail section 5.

The rocker 11A is provided with a cup 12 on each of the aforesaid portions which cooperate with the tappet 6 and the piston-rod 9 (as shown in FIGS. 3, 5, 6) in order to receive a substantially hemispherical face 13A of a half-ball joint component 13 which is concentric with the cup 12. A substantially equatorial flat face 13B of each half-ball 13 forms a projection above the cup 12 in order to be applied against a corresponding flat face of the vertical-motion tappet 6 and against a flat face of the extremity of the piston-rod 9 respectively.

Figure 4:
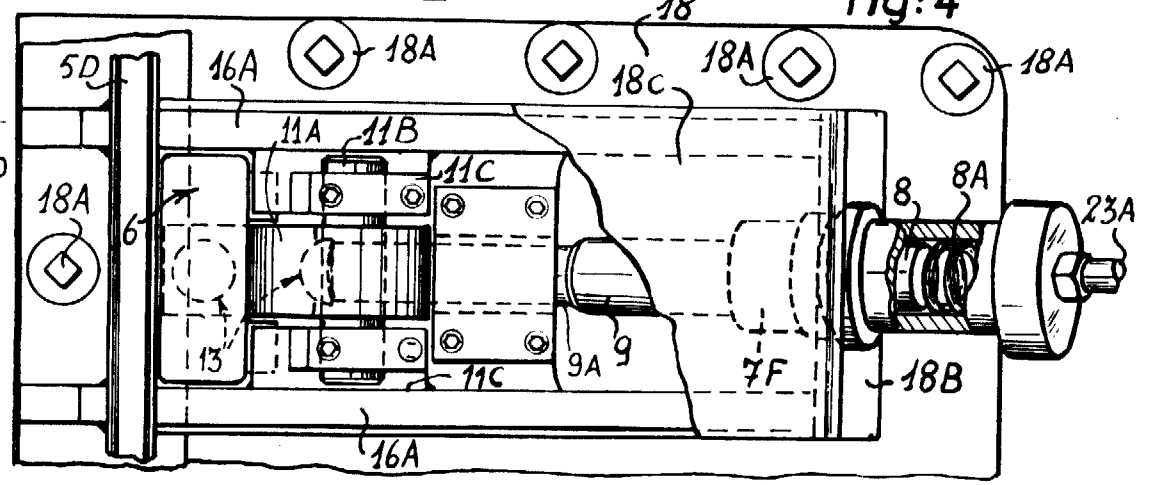
FIG. 4 is an overhead plan view of the device shown in FIG. 3, this view being taken along line IV—IV.

Thus, as will be explained hereinafter, the flat equatorial face 13B of each half-ball joint component 13 is capable of sliding freely against the opposite flat face of the vertical-motion tappet 6 or of the extremity of the piston-rod 9 for the operation of the motion converter, taking into account the circular path followed by each cup 12. Preferably, an intermediate thrust member 9A is interposed between the extremity of the piston-rod 9 and the corresponding half-ball 13 (as shown in FIGS. 3 and 4).

The half-ball 13 and the associated components of the motion converter 11 can be formed of all suitable materials. For example, the tappets 6 and thrust members 9A are of steel as well as the rocker 11A, and the half-ball 13 is of high-strength bronze. All the components can also be formed of steel and an anti-friction lining of bronze, for example (not shown) can be placed within the cups 12 of the rocker 11A and on the flat faces of the tappets 6 and thrust members 9A which are associated with the half-balls 13.

By virtue of the arrangements and choice of materials indicated in the foregoing, the mechanisms of the track brake in accordance with the invention are capable of operating without lubrication.

In the direction of travel of the wheel 4 to be braked (arrow F of FIGS. 2, 5, 6, 7), the first tappet 6A is preferably a weighing tappet associated with a weighing hydraulic jack 7A as will be explained below. The weighing tappet 6A has a convex top face 17A (as shown in FIG. 5) which forms in the rest position of the tappet a slight projection 17B above the level of the summit or top face of the braking rail 5D. For example, the height of projection 17B is of the order of 10 mm.

The vertical-motion tappets 6B, 6C, 6D, 6E which follow the weighing tappet 6A are preferably braking tappets. The profiled top portion 17C of each tappet which projects above the braking rail 5D (as shown in FIG. 6) advantageously has a slop 17D in the intended direction of travel of the wheel 4 as indicated by the arrow F. The slop 17D ensures uniform downward displacement of the tappet 6 at the time of passage of the wheel 4 over a distance of travel corresponding to the height of projection 17E of the tappet 6 in the rest position (as shown in FIGS. 5 and 6), namely approximately 50 mm, for example. As mentioned hereinafter, the uniform downward displacement of the tappet 6 prevents dynamic pressure defects in the hydraulic brake circuits which will be described hereinafter.

The structure of the modular unit constituted by the track brake (shown in FIGS. 1, 2, 4) comprises a bed-plate 18 formed for example of sheet steel having substantial thickness and secured by means of screw-spikes 18A to the crossties 3A of that portion of the shunting track in which the brake unit is installed. The bed-plate 18 carries the braking rail section 5, the guides 16A of each vertical-motion tappet 6, the brackets 11C for supporting the pivot-pin 11B of the rocket 11A of the motion converter and the associated hydraulic cylinders 7A, 7B, 7C, and so forth.

As shown in FIGS. 1 to 4, the hydraulic cylinders 7 are substantially horizontal and mounted on a rear plate 18B, for example. Said rear plate is rigidly fixed to the bed-plate 18 and forms together with this latter a casing which is closed by a detachable cover 18C in order to protect the brake components from dust and bad weather conditions.

In the embodiment which is described herein by way of example (with reference to FIGS. 2, 7, 8), the track brake 1 is constituted first by the weighing tappet 6A associated with the weighing hydraulic jack 7A, then by four braking tappets 6B, 6C, 6D, 6E. These latter are each associated with a brake cylinder 7B, 7C, 7D, 7E which operates by throttling a suitable fluid such as a non-freezing mineral oil which is resistant to ageing. The track brake in accordance with the invention comprises means for adjusting the throttling action of the fluid on demand, according to the weight carried by each wheel 4. This weight is measured by means of the weighing tappet 6A and the associated jack 7A.

Preferably, the adjusting means aforesaid comprise (as shown in FIGS. 7 and 8) a brake-application regulator 21 having an opposing spring 22 associated with a weighing piston 22A which is controlled by the weighing tappets 6A. Said tappet is placed before the first braking tappet 6B in the direction of travel of the cars indicated by the arrow F and is associated with the weighing hydraulic cylinder 7A which is similar, for example, to the brake cylinders 7B to 7E.

The brake-application regulator 21 is mounted in a hydraulic circuit 23 (FIG. 7) to which discharge pipes 23A of each brake cylinder 7B to 7E are connected in parallel. Throttling of the fluid discharged from the brake cylinders is carried out within the regulator 21 by means of a throttling piston 24 which is applied against its seating 24A by the weighing spring 22.

Check valves 25 are mounted in the discharge pipe 7A1 of the weighing hydraulic cylinder 7A and in the discharge pipes 23A of the brake cylinders 7B to 7E. All the cylinders mentioned above are connected directly to a common hydraulic reservoir 26 by means of a supply circuit 27. This latter is connected to each discharge pipe 7A1, 23A, by means of a check valve 28 which operates in the direction opposite to the discharge valve 25 of the same pipe.

Check valves 28 prevent the flow of the fluid which is forced back by the cylinders 7 when the pistons 8 are displaced downwards therein and compress the restoring springs 8A. However, the valves 28 permit the flow of fluid from the supply circuit 27 to the cylinders 7 when the pistons 8 are brought back to the rest position by the restoring springs 8A as will be explained hereinafter.

The track brake can advantageously comprise means for detecting the speed of the car wheel 4 combined with retarding means, in order to make these latter inoperative below a predetermined value of speed of the wheel, in order to prevent excessive brake action on freight cars.

In the embodiment which is illustrated diagrammatically in FIGS. 7 and 8, the means for detecting the speed of the wheel 4 comprise a flow-threshold valve 31 in which an obturator disc 31A is held at a distance from a valve-seat 31B by a spring 31C below a predetermined value of fluid flow corresponding to the rate of downward displacement of a braking tappet 6B to 6E in respect of the aforementioned limiting speed of the wheel 4.

The threshold valve 31 is mounted as a by-pass off the brake-application regulator 21 in the discharge circuit 23 of the brake cylinders. In this manner, the fluid discharge from the brake cylinders 6B to 6E is subjected to the choking action of the throttling piston 24 within the regulator 21, only when the speed of the wheel 4 oversteps the limiting value permitted by the track brake. A limiting value of 0.8 m/sec is chosen by way of example.

Below the aforesaid speed of the wheel, the threshold valve 31 remains open, thus making the throttling piston 24 inoperative and preventing brake action on the wheel 4.

The brake-application regulator 21 preferably comprises a clearing device for producing the expansion of the weighing spring 22 which has previously been compressed by the weighing tappet 6A. The device for clearing the weighing operation can be controlled by means of a clearing tappet 6F which is placed after the last braking tappet 6E in the direction of travel of the wheel 4 as indicated by the arrow F in FIG. 7. The clearing tappet 6F is similar, for example, to the weighing tappet 6A (as shown in FIGS. 5 and 7).

In the embodiment which is illustrated by way of example in FIGS. 5 and 7, the clearing tappet 6F actuates a piston mounted within a hydraulic cylinder 7F which is similar for example to the weighing cylinder 7A. The clearing cylinder 7F is connected by means of a clearing pipe 33 to a clearing relay 34 which controls a discharge valve 35 mounted in a pipe for connecting the chamber of the weighing piston 22A to the circuit 27 of the hydraulic reservoir 26.

In this manner, downward displacement of the clearing tappet 6F causes the discharge of fluid from the chamber of the piston 22A, and expansion of the weighing spring 22 which has previously been compressed by the weighing tappet 6A.

As shown diagrammatically in FIGS. 1 and 2, the brake-application regulator 21, the hydraulic reservoir 26 and the different valves 25, 28, 35 of FIG. 7 can advantageously be grouped together within a weatherproof casing 37. The discharge pipes of the cylinders 7A to 7E converge towards the casing 37 and are protected outside this latter by means of sheaths 38 such as metallic sheaths, for example.

Preferably, all similar components such as tappets 6, piston-rods 9, pistons 8, hydraulic cylinders 7 are interchangeable. The same applies to the various similar components of the motion converters of the successive track-brake elements, namely the rocker 11A, the half-ball joint components 13, the horizontal thrust member 9A (as shown in FIGS. 3 and 4). As has been noted earlier, the mechanical components of the track brake in accordance with the invention are capable of operating without any special lubrication, this being permitted by the choice of materials of associated parts and by the degree of machining of these latter.

Operation of the track brake described in the foregoing with reference to FIGS. 1 to 7 will now be explained. The track brake which is mounted in the service position on the shunting track is assumed to be in the rest position corresponding to the diagrammatic FIGS. 7 and 8. In particular, all the pipes of the different hydraulic circuits are assumed to be filled with fluid after air has been bled from said pipes by means of suitable orifices (not shown) located at a number of suitable points in the circuits.

When a wheel 4 of the car travelling in the direction of the arrow F (as shown in FIGS. 5 and 7) reaches the convex top portion 17A of the weighing tappet 6A which forms a slight projection 17B above the braking rail 5D, the weighing tappet 6A is displaced downwards under the weight of the wheel 4. The tappet causes displacement of the rocker 11A of the motion converter 11 and the piston-rod 9 (as shown in FIGS. 3 and 5). The piston 8 compresses the restoring spring 8A within the weighing cylinder 7A (FIG. 7) and discharges the fluid from the cylinder. The fluid discharged from the weighing cylinder 7A via the pipe 7A1 passes through the valve 25 and produces action within the regulator 21 on the weighing piston 22A, thus compressing the weighing spring 22 to a predetermined extent which depends on the weight of the wheel 4. For a brief instant, said wheel is then in equilibrium on the weighing tappet 6A which in turn remains stationary.

Thus the downward displacement of the weighing piston 22A within the regulator 21 (as shown in FIGS. 7 and 8) defines the downward travel of the convex portion 17A of the weighing tappet 6A (shown in FIG. 5) with respect to its rest position. It has been noted that this rest position projects upwards over a small distance to the level 17B which is equal to approximately 10 mm, for example, above the top level of the braking rail 5D.

By choosing the ratio of useful cross-sectional areas of the piston 8 of the weighing jack 22A of the regulator 21 (as shown in FIGS. 7 and 8) as well as the characteristics of the restoring spring 8A and the weighing spring 22, steps are taken to ensure that the distance of upward projection 17B of the top face 17A of the weighing tappet 6A (shown in FIG. 5) still remains to a partial extent for weighing the maximum permissible weight of the wheel 4. By way of example, this maximum weight is equal to 10 (metric) tons. A residual value of the order of 2 mm, for example, can be established by design so as to correspond to said maximum weight in the case of the distance of projection 17B of the weighing tappet 6A above the braking rail 5D (as shown in FIG. 5).

After the wheel 4 has passed over the weighing tappet 6A, the restoring spring 8 returns the tappet 6A to the rest position at a distance of projection of approximately 10 mm above the level of the top face of the braking rail 5D. At the same time, the piston 8 draws a certain quantity of fluid from the reservoir 26 via the supply circuit 27 and the valve 28 of the weighing pipe 7A1. However, the weighing valve 25 ensures that the piston 22A is maintained stationary and that the weighing spring 22 is maintained in the compressed position, thus holding the throttling piston 24 against its seating 24A as a function of the weight of the wheel 4 which is measured by the extent of downward displacement of the weighing tappet 6A.

As shown in FIGS. 6 and 7, the wheel 4 then moves successively to each of the braking tappets 6B to 6E. The braking tappet such as 6B moves downwards at a substantially constant speed each time as a result of the uniform slope 17D of its top face 17C which projects above the top face of the braking rail 5D (as shown in FIG. 6). The rocker 11A of the motion converter then initiates compression of the restoring spring 8A of the corresponding brake cylinder 7B to 7E (FIG. 7) and downward displacement of the piston 8 within the cylinder 7 (as shown in FIGS. 3 and 7) at a uniform speed. The fluid is thus discharged from the brake cylinder 7 without any irregularity of dynamic pressure within the brake-application pipe 23 which terminates in the regulator 21 and in the threshold valve 31 which is mounted as a by-pass.

If the speed of the wheel 4 (shown in FIG. 7) is over the minimum value which is permitted for the operation of the track brake and is equal to 0.8 m/sec, for example, the movable obturator 31A of the threshold valve 31 (shown in FIG. 8) compresses the spring 31C under the action of the flow of fuel which is admitted through the brake-application pipe 23. The valve 31 closes, thus causing the entire quantity of fluid to pass through the brake-application regulator 21. In this latter, the fluid is subjected to a choking action by the throttling piston 24, the pressure of application of said piston against its seating being dependent on the compression of the weighing spring 22. Thus the brake action transmitted to the wheel 4 as a result of resistance to downward displacement of each braking tappet 6B to 6E is of greater or lesser intensity according to the weight measured by the weighing tappet 6A and resulting in compression of the weighing spring 22.

As long as the speed of the wheel 4 remains higher than the limiting speed permitted for the track brake 1, the obturator 31A of the threshold valve 31 is applied against its seating 31B by the flow of fluid which is discharged successively by each of the pipes 23A of the brake cylinders 7B to 7E. Thus the wheel 4 is subjected to brake action as long as the wheel speed exceeds the minimum value mentioned earlier, namely 0.8 m/sec, for example.

On the other hand, if the speed of the wheel 4 falls below the minimum value aforementioned, for example before the wheel reaches the braking tappet 6E (shown in FIG. 7), said tappet becomes inoperative. In fact, the rate of fluid flow within the threshold valve 31 is insufficient to apply the movable obturator 31A against the seating 32 and the valve 31 remains open. Under these conditions, the fluid discharged from the brake cylinder 7E can pass through the by-pass 31D instead of being subjected to the choking action produced by the throttling piston 24 within the regulator 21.

By virtue of the aforementioned system for putting the regulator 21 out of circuit, steps are taken to prevent any reduction in speed of the wheel 4 below the limiting speed indicated earlier, in order to maintain uniform rolling motion of the car and a sufficiently high rate of classification yard operations.

The threshold valve 31 can advantageously comprise a regulating device for adjusting the compression of the spring 31C on demand, so as to correspond to the threshold flow rate of fluid in respect of the limiting speed of the wheel 4 below which the brake action is intended to be inoperative. Adjustment of the spring 31 can take place, for example, by means of an external screw 31E as shown diagrammatically in FIG. 8.

When the wheel 4 reaches the clearing tappet 6F, discharge of the fluid from the cylinder 7F via the clearing pipe 33 (shown in FIG. 7) has the effect of actuating the clearing relay 34, thus in turn having the effect of opening the discharge valve 35. This permits discharge of the fluid from the chamber of the piston 22A towards the reservoir 26 and expansion of the weighing spring 22. The regulator 21 is thus ready to receive from the weighing tappet 6A an indication of the weight of the wheel which follows the first wheel 4. Since the tappets 6A to 6F are disposed along a limited length 5L (FIGS. 2 and 7) which is shorter than the distance between the wheels 4 of the two axles of one bogie of the car, brake application on the second wheel of a bogie is not liable to be adversely affected by late clearing initiated by the first wheel. Moreover, the clearing tappet 6F makes all the braking tappets 6E to 6B inoperative in the case of the wheels of a train which is moved back along the shunting track in the direction opposite to the arrow F (shown in FIG. 7).

The track brake in accordance with the invention offers a number of advantages over brake systems of known types.

The design of the track brake in the form of a modular unit adapted to the spacing of the crossties of the classification track permits economical industrial manufacture and easy erection of the brake unit. The bed-plate 18 (shown in FIGS. 1 to 4) is advantageous in this respect since the brake unit can be securely and conveniently fixed on the crossties of the track.

Since the braking rail section 5 has an upper profile of reduced thickness in that portion 5D which is located between the two end portions 5A, 5B, convenient lateral assembly of the tappet 6 opposite to the tires of the wheels 4 is accordingly permitted. It is thus possible to give the tappet 6 a sufficient width (as shown in FIG. 3) which is conducive to mechanical efficiency as well as endurance of the tappet over a long period of service.

By virtue of a profile which is identical with that of the ordinary rails 2 of the track, the two end portions 5A, 5B of the braking rail make it possible to connect the braking rail section 5 to the adjacent rail 2 in a convenient and secure manner, for example by means of ordinary fish-plates 5C (as shown in FIG. 2).

By arranging the weighing tappet 6A and the clearing tappet 6F over a limited length 5L which is shorter than the distance between the wheels of the two axles of one bogie, it is thus possible to prevent late passage of the first wheel over the clearing tappet 6F which would be liable to impair the brake action on the following wheel which has already engaged on the track brake 1. The horizontal arrangement makes it possible to give the desired dimensions to the cylinders 7A to 7F and especially to the braking cylinders 7B to 7E without having to form recesses in the track ballast which would have an adverse effect on the ease of installation of the brake unit.

The form of construction provided for the horseshoe tappet 6 (shown in FIGS. 5 and 6) and for the rocker 11A of the motion converter which is associated with each tappet and rigidly fixed on the bed-plate 18 (as shown in FIG. 3) makes it possible to endow the mechanical components of the brake unit with a high degree of strength and ruggedness in order to afford resistance to repeated impacts of the wheels 4 to be braked over a long period of time.

The components aforesaid and the half-ball joint components 13 (shown in FIGS. 5 and 6) which are associated with the vertical-motion tappets 6, with the rockers 11A and with the thrust members 9A of the piston-rods 9 can be formed for example of treated steel, of special high-resilience cast-iron or of high-strength bronze. These materials make it possible to obtain an excellent state of surface which is conducive to mechanical efficiency of the motion converter of each element for weighing, braking or clearing the track brake. All these components and especially the removable half-balls 13 can readily be replaced.

The aforesaid state of surface ensures high smoothness of sliding motion of the substantially equatorial planes 13B of the half-balls 13 on the associated flat faces of the tappets 6 and thrust members 9A. The same applies to the sliding motion of the substantially hemispherical faces 13A of the half-balls 13 within the cups 12 of the rocker 11A of each motion converter of the track brake. The choice of the materials constituting the moving parts and the machining of these latter thus make it possible to ensure operation of the track brake without any particular lubrication.

The slope 17D of the projecting portion of each braking tappet such as the tappet 6B (shown in FIG. 6) ensures downward displacement of this latter at a substantially uniform speed at the time of passage of the wheel 4 (shown in FIGS. 1, 6, 7) irrespective of the diameter "D" of the wheel. This results in a uniform rate of flow of the fluid through each brake cylinder 7B to 7E at the time of passage of the wheel 4 to be braked. This accordingly prevents any irregularities of dynamic pressure of the fluid within the discharge pipes of the hydraulic cylinders which would be liable to disturb the operation of the brake-application regulator 21 and the efficiency of the track brake.

By employing a single regulator 21 for all the brake cylinders 7B to 7E, each cylinder is endowed economically with accurate regulating means for automatic brake application which is exactly adapted to the weight of each wheel by means of the weighing system which is controlled in dependence on the tappet 6A. By virtue of the clearing system controlled by the exit tappet 6F, the track brake is prepared to receive a fresh wheel each time in order to produce an accurate brake application on this latter.

The threshold valve 31 which is connected as a shunt off the regulator 21 makes it possible to conform to a bottom speed limit of the wheel 4 while preventing excessive brake action which would be liable to impair normal rolling motion of the car and to reduce the rate of classification operations. For example, by adopting a bottom speed limit in the vicinity of 0.8 m/sec, abnormal impact of cars is prevented without any need to resort to uneconomical reduction of spacing between track brake units.

As can readily be understood, the invention is not limited to the embodiment described in the foregoing by way of example, and a number of different alternative forms can accordingly be devised without thereby departing either from the scope or the spirit of the invention.

There is thus shown in FIG. 9 an alternative embodiment 41 of the brake-application regulator of the track brake unit in accordance with the invention. Said regulator comprises a fluid-throttling piston 42 associated with a throttling piston-seating 42A which is connected to the discharge circuit 23 of the brake cylinders. The throttling piston is subjected to the bearing pressure of an auxiliary spring 43 which is mounted within a bearing chamber 43A and controlled in dependence on a weighing pilot piston 44 controlled by the pressure of the discharge pipe 7A1 of the cylinder 7A which is associated with the weighing tappet 6A (as shown in FIG. 6).

The weighing pilot piston 44 thus ensures compression of the opposing weighing spring 45 in order to determine the value of a leakage pressure of the bearing chamber 43A which is connected by means of an internal duct 46 to the discharge circuit 23 of the brake cylinders. The leakage pressure determined by the compression of the weighing spring 45 thus defines the value of hydraulic pressure within the chamber 43A which is exerted on the rear face of the throttling piston 42 and maintained by the pressure of fluid within the brake pipe 23.

This mode of follow-up control of the regulator 42 makes it possible to improve the sensitivity and accuracy of the weighing system of the track brake in accordance with the invention since it is accordingly only necessary to apply a low pressure to the pilot piston 44 through the weighing pipe 7A1.

In accordance with another alternative embodiment (shown in FIG. 10), the regulator 41 which is similar to the regulator of FIG. 9 is associated with a controlled slide-valve 47 which replaces the threshold valve 31. The controlled slide-valve 47 is mounted in a lateral pipe 47A which is connected to the brake pipe 23 through the internal duct 46 of the regulator. The slide-valve 47 is maintained in the rest position within a casing by means of a spring 47B in such a manner as to ensure that an annular chamber 47C of the slide-valve accordingly puts the by-pass line 47A into communication with the pipe 27 of the hydraulic reservoir 26.

A lateral branch pipe 48A is connected to the discharge pipe 48 of the throttling piston 42 upstream of an adjustable calibrated orifice 48B. As a function of the rate of flow of fluid through the calibrated orifice 48B at the moment of brake application, a predetermined pressure is thus generated within the branch pipe 48A which terminates in the casing of the slide-valve 47 in opposition to the spring 47B through a spring-loaded valve 48C having a calibrated orifice.

The velocity of the fluid which flows through the calibrated discharge orifice 48B (shown in FIG. 10) corresponds to the speed of the wheel 4 which passes over the braking tappets 6B to 6E (shown in FIG. 7). When the speed of the wheel exceeds a predetermined bottom limit such as 0.8 m/sec, for example, the pressure of the fluid of the lateral pipe 48A displaces the slide-valve 47, thus cutting-off the communication between the by-pass line 47A and the pipe 27 of the hydraulic reservoir. Thus the entire quantity of fluid discharged from the brake cylinders into the pipe 23 is subjected to the action of the throttling piston 42 when the speed of the wheel 4 (FIG. 7) exceeds the limit aforesaid.

There is shown in FIG. 11 a similar arrangement of the brake-application regulator 41 associated with a lateral slide-valve 47E which is connected in this instance upstream of the regulator before an adjustable calibrated orifice 48E. This orifice which is located upstream of the regulator 41 is thus protected from any dynamic pressure disturbances resulting from the throttling piston 42 which would be liable to affect the calibrated orifice 48B of FIG. 10.

The arrangement shown in FIG. 11 accordingly ensures operation of the short-circuiting slide-valve 47E in both directions in a flexible and reliable manner. In the rest position (FIG. 11), the slide-valve 47E short-circuits the throttling piston 42 in the by-pass line 47F as long as the speed of the wheel 4 to be braked (FIG. 7) is below the predetermined value mentioned above. Should this not be the case, the slide-valve 47E is accordingly brought to the closed position (not shown) as a result of the dynamic pressure generated by the calibrated orifice 48E which causes the entire quantity of fluid discharged into the brake pipe 23 to be subjected to the action of the throttling piston 42.

There is shown in FIG. 12 a further alternative embodiment of the track brake in accordance with the invention which is similar to the track brake shown in FIG. 7 but is provided with an additional clearing tappet 6G which is similar to the clearing tappet 6F already described. The additional clearing tappet 6G is associated with a hydraulic jack 7G which is similar to the jack 7F and mounted at the end opposite to the tappet 6F with respect to all the other tappets 6A to 6E. In the same manner as the hydraulic jack 7F, the jack 7G is connected by means of a pipe 33A to the clearing relay 34 which controls the discharge valve 35 of the weighing system of the regulator 21.

The additional clearing tappet 6G (shown in FIG. 12) is intended to ensure expansion of the weighing spring 22 after the passage of a train along the track in which the brake unit in accordance with the invention is installed, in the direction of the arrow F1 opposite to the direction of the arrow F of FIG. 7. A train which travels back along the track in the direction of the arrow F1 is not subjected to any braking action since each wheel 4 first actuates the clearing tappet 6F (FIG. 7) which ensures expansion of the weighing spring 22. However, the last wheel 4A of the train produces action on the weighing tappet 6A and would thus leave the weighing spring 22 in the compressed state. The additional tappet 6G (shown in FIG. 12) has the effect of removing this disadvantage and of preparing precise adaptation of the track brake to the weight of a fresh wheel 4 to be braked in the direction of normal travel corresponding to the arrow F.

It is readily apparent that constructional arrangements are made to ensure that the overall length of all the tappets 6A to 6G which are disposed along the braking rail 5D (as shown in FIG. 12) does not exceed the limited length 5L as already defined in connection with FIGS. 2 and 7. The length 5L must be smaller than the distance between the wheels 4 of one bogie (not shown) of the freight car to be braked. This distance or wheel spacing is equal to 1.80 meter, for example.

In yet another alternative embodiment of the track brake in accordance with the invention, it is possible to dispense with the clearing tappet 6F (shown in FIG. 7) or the clearing tappets 6F and 6G (FIG. 12) as well as the associated hydraulic jacks 7F, 7G by means of an automatic time-controlled clearing circuit combined with the brake-application regulator such as the regulator 21 (shown in FIGS. 7 and 8) or the regulator 41 (shown in FIG. 9). The aforementioned automatic clearing circuit is provided by way of example with a calibrated leakage throat which permits within a pre-established time interval a discharge of fluid for ensuring application of the throttling piston 22A, 42 either directly (as shown in FIGS. 7 and 8) or by means of the pilot piston 44 (as shown in FIG. 9).

In the embodiment shown in FIG. 13 which corresponds to the case of the controlled regulator 41, the calibrated throat 50 is preferably adjustable and disposed in a discharge pipe 50A which is connected at 50B to the weighing pipe 7A1 between the check valve 25 and the constricted orifice or throat 50 for putting the pilot piston 44 under pressure within the regulator 41.

As long as a discharge pressure of the weighing cylinder 7A is exerted, the low rate of flow of the leakage orifice 50 is insufficient to modify the compression of the opposing weighing spring 45 to any appreciable extent, thus defining the bearing pressure of the controlled throttling piston 42 as has been noted with reference to FIG. 9. On the other hand, as soon as the discharge pressure is no longer exerted within the weighing pipe 7A1, the rate of flow through the constricted leakage orifice or throat 50 produces action so as to begin to reduce the compression of the opposing weighing spring 45.

In practice, the value of the caliber of the leakage throat 50 is chosen so as to ensure expansion of the opposing spring 45 from a value of compression corresponding to the maximum permissible weight in the case of a last car wheel, namely 10 (metric) tons for example, and at least down to a low value of compression corresponding to the minimum weight which is possible for the first wheel of another car, namely 2 tons, for example. It is assumed that the second car immediately follows the first car, which represents for example a distance of only 2.44 meters between the wheels considered. It is also assumed that the two cars travel at the maximum speed contemplated on the shunting track, namely 1.50 m/sec, for example.

Taking into account the values indicated in the foregoing, it is possible to calculate the minimum time interval in which expansion of the opposing spring 45 should be capable of taking place and consequently to adjust the caliber of the leakage throat 50. The time-controlled clearing circuit system also makes it possible to avoid the dead times related to the operation of the clearing system controlled by the exit tappet 6F which was described with reference to FIG. 7.

As a preferable feature shown in FIG. 13, the calibrated-leakage automatic clearing circuit associated with the regulator 41 further comprises an auxiliary pipe 50D for putting the weighing circuit under pressure. The auxiliary pipe 50D connects the point 50B of the weighing pipe 7A1 to the brake pipe 23 through a check valve 50E. In this manner, each pressure pulse transmitted to the brake pipe 23 by one of the successive braking tappets 7B to 7D (FIG. 7) has the effect of compensating for the leakage produced by the throat 50. Substantially equivalent useful cross-sectional areas are chosen for the weighing cylinder 6A and the brake cylinders 7B to 7E in order to return substantially to the initial value of the weighing pressure of the cylinder 7A at each operation of the brake cylinders 7B to 7E.

Thus the brake cylinders each come into action in turn after the weighing cylinder 7A in order to reproduce the braking pressure which has already been delivered by this latter to the weighing pilot piston 44. By virtue of this complementary function of the brake cylinders, it is possible to give a relatively large caliber to the leakage throat 50. This advantage is important in order to prevent any danger of irregular operation of the automatic clearing system since a throat of excessively small caliber is liable to be obstructed by impurities in suspension in the fluid.

As can readily be understood, an automatic clearing system which is similar to that of FIG. 13 can be associated with the direct-action regulator 21 of FIGS. 7 and 8. In this case, the leakage pipe (not shown) has an adjustable calibrated throat which is similar to the throat 50 and is located (as shown in FIG. 7) between the inlet of the weighing pipe 7A1 within the regulator 21 and the reservoir pipe 27.

A number of other alternative embodiments of the track brake in accordance with the invention can also be contemplated. By way of example, it is clearly possible to form a modular braking unit comprising two braking rail sections (not shown) which are placed side by side and are each similar to the braking rail section 5 of FIG. 2. An arrangement of this type will be adopted in particular for the purpose of reducing the length 5L of each track brake since the brake action is then doubled for the same length of brake unit.

Similarly, it is apparent that the track brake can comprise any number of brake-application members such as the members associated with the cylinders 7B to 7E of FIG. 2. The track brake can thus be constituted, for example, by six or eight brake-application members which make it possible to obtain enhanced brake action in the case of members having the same power as those of FIG. 2. At the cost of an increase in length of the track brake 1, it will also be possible in this manner to reduce the energy absorbed by each member and to attenuate corresponding impacts or again to reduce the number of track brakes 1 to be installed in respect of a given length of the shunting track. It is thus possible to achieve a most satisfactory compromise between the contradictory requirements of efficiency and endurance of the brake units and the desire to keep the cost price as low as possible in all automatic braking installations to be provided on the multiple tracks of a classification yard.

In FIG. 2, there is shown by way of example one embodiment of the track brake in accordance with the invention which is mounted beforehand on special crossties 3A on which there have been fixed the bedplate 18 together with the braking rail section 5D plus the two check-rails 5E. In order to position the complete track brake unit of FIG. 2, all the screw-spikes (not shown) are removed from the standard crossties of the track in that portion which is intended for the track brake 1. The two ordinary rails 2 are lifted in order to withdraw the standard crossties. One of the rails 2 is cut to the length which is necessary for mounting the braking rail section 5. The special crossties 3A of the track brake can then be introduced in the flat position beneath the intact rail 2, the rails 2 are lowered in order to fix the intact rail 2 on the crossties 3A and the two end portions 5A, 5B of the braking rail section are joined to the cut rail 2.

It is of course also possible to avoid part of the operations mentioned above if this is permitted by the strength of the ordinary crossties 3 of the shunting track. It is only necessary in this case to remove the screw-spikes from the ordinary rail 2 to be cut in order to place the braking rail section 5 in position. The bedplate 18 is then placed on the ordinary crossties 3 of the shunting track; after this operation, the two check-rails 5E are also laid on the crossties, and the braking rail section 5 is joined to the cut rails 2.

The choice between the two modes of positioning of the track brake which may or may not be mounted beforehand on special crossties will dependent in particular on the strength of the standard crossties of the classification track to be equipped.

In the different embodiments which have been described thus far, one of the important advantages of the track brake in accordance with the invention lies in the existence of means for clearing the weighing operation so as to permit reversal of at least one car along the track in the direction opposite to the normal direction of braking, without thereby producing any brake application and without any attendant danger of immediate or subsequent incidents.

As has already been noted, the above-mentioned clearing means are of the direct-control type in the case of the clearing tappets 6F, 6G (as shown in FIG. 12) or of the automatic time-controlled operation type associated with the calibrated throat 50 (shown in FIG. 13). Releasing of the opposing weighing spring 45 or 22 which is effected by means of these clearing means (FIGS. 9 to 13) makes it possible for a car to travel along the track in the direction opposite to the direction of normal braking without any brake application and without any troublesome occurrences.

The industrial development of the track brake which has been described with reference to FIGS. 1 to 13 has clearly shown the advantage of a certain number of improvements resulting in substantially enhanced endurance of the tappets and associated rockers (shown in FIGS. 1 to 6) which are repeatedly subjected to the impacts of car wheels which pass over the tappets.

The object of these improvements is to permit the construction of a track brake having high endurance and resistance to repeated impacts of wheels to be braked.

In the embodiment shown in FIGS. 14 and 15, the track brake is provided with retarding means which are installed in the service position along a braking rail 51 of the track and are equipped with a certain number of tappets such as the tappet 52. In the rest position, each tappet has a portion which projects upwards with respect to the level of the top face of the braking rail 51 in order to be applied successively beneath each wheel 53 of the car which passes over the track brake in the direction of the arrow F (as shown in FIG. 14).

Each tappet such as the tappet 52 is associated with a hydraulic cylinder 54 fitted with a piston 55 which is connected to the tappet 52 and subjected to the action of a restoring spring 56 which urges the tappet towards its rest position. The track brake comprises a motion converter constituted by a series of rockers such as the rocker 57 each having a pivot-pin such as the pin 57A which is secured to the braking rail 51 by means of a bed-plate 58, for example. A portion of each rocker such as the rocker 57 cooperates with the tappet such as the tappet 52; another portion cooperates in a direction which is transverse to the braking rail 51 with a piston such as 55 of a substantially horizontal hydraulic cylinder such as 54.

The track brake can comprise at least one weighing tappet, one braking tappet and one clearing tappet.

Each braking tappet of the type designated by the reference 52 comprises a horseshoe body having two substantially parallel arms 61A, 61B slidably mounted in guides 62 which are rigidly fixed to the braking rail 51 (as shown in FIG. 14). The two arms 61A, 61B are joined together by means of a shaped top portion located in a projecting position above the level of the top face of the braking rail 51 in the rest position of the tappet. A bearing face 63 of said top portion has a substantially constant slope having an angle 63A with respect to the rail 51 in order to ensure uniform downward displacement of the braking tappet 52 at the time of passage of each wheel 53 of the car to be braked.

In accordance with a first improvement, the guides 62 which are rigidly fixed to the braking rail 51 are at right angles to the constant-slope bearing face 63 of the braking tappet 52. Furthermore, the pivot-pin 57A of the motion-transmission rocker 57 associated with the braking tappet 52 is parallel to the bearing face 63 aforesaid in a vertical plane which is parallel to the braking rail 51.

The orientation of the guides 62 at right angles to the bearing face 63 is such as to prevent said guides from being subjected to a lateral component of substantial value in the direction of the arrow F (FIG. 14) at the moment when the wheel 53 comes into contact with the bearing face 63 of the braking tappet 52. Guiding of the parallel arms 61A, 61B within the guides 62 accordingly takes place easily and without any attendant danger of jamming or seizure. This accordingly has the advantage of long service life of the mechanism of the braking tappet 52 and of the associated rocker 57.

There is shown in FIGS. 16 to 22 a further improvement in a track brake comprising a certain number of tappets each associated with a motion-transmission rocker.

In accordance with this second improvement, each tappet forms part of the associated motion-transmission rocker such as, for example, the clearing rocker 71, the weighing rocker 72 or one of the braking rockers 73. Each rocker 71, 72, 73 is mounted on a pivot-pin 74 contained in a vertical plane which is parallel to the braking rail 51. By way of example, the pivot-pin 74 is parallel to the top face of the rail 51 and common to all the motion-transmission rockers. With respect to the pivot-pin 74 of each rocker 71, 72, 73, the tappet aforesaid constitutes a radial projection provided at the top with a profiled bearing face 71A, 72A, 73A, said bearing face being intended to cooperate with each wheel 53 of the car to be braked (as shown in FIG. 16 and in FIGS. 18 to 22).

The combination of the tappet and the motion-transmission rocker in a single component facilitates economical industrial construction of the brake unit in accordance with the invention and makes it possible to reduce the overall length of the mechanisms to be mounted in the brake unit in side-by-side relation as will be explained hereinafter. A further advantage of such a combination lies in the fact that each rocker and radial projection can be given substantial dimensions which are conducive to higher strength without thereby increasing the overall size of the track-brake unit as a whole.

As illustrated in FIGS. 16, 18 and 19, the braking rail 51 at a point opposite to each rocker 71, 72, 73 is preferably provided with a stop 75 against which a lateral boss 76 of the rocker is capable of bearing in the rest position. This makes it possible to define in the rest position aforesaid the height of the bearing face 71A, 72A, 73A of each rocker with respect to the level of the top face of the adjacent rail 51. The rest-position stop 75 associated with the motion-transmission rocker such as the rocker 72 or 73 (shown in FIGS. 18 and 19) is advantageously mounted on the rail 51 in a removable manner, for example by means of bolts 75A.

The track brake comprises a weighing tappet for determining the weight of each wheel 53 (FIG. 18) and consequently for controlling a brake-application regulator which may be the same as the regulator 21 shown in FIGS. 7 and 8 and is associated with each hydraulic brake cylinder 73C (FIG. 19).

The bearing face 72A of the radial projection of the rocker 72 which constitutes the weighing tappet is substantially flat and parallel to the upper portion of the adjacent rail 51 (as shown in FIGS. 18 and 20) and to the pivot-pin 74 of the weighing rocker 72. Preferably, the upper portion of the braking rail 51 located opposite to the bearing face 72A which constitutes the weighing tappet has a recess 77 cut out below the level of the top face of the remainder of the braking rail 51 (as shown in FIGS. 3, 5 and 7). The substantially flat bearing face 72A of the weighing rocker 72 is located substantially at the same level as the top face of the normal portion of the braking rail 51 in its rest position as defined by the stop 75 (FIG. 18).

The feature which has just been described has the advantage of preventing dynamic effects in the vertical direction whenever each wheel 53 comes to rest on the weighing tappet constituted by the bearing face 72A of the rocker 72. This accordingly ensures accurate adjustment of the brake-application regulator, with the result that each braking tappet can subsequently produce action with the maximum degree of efficiency.

With the same objective, the bearing face 73A of each braking rocker 73 (shown in FIGS. 19 and 22) has an upwardly sloping portion which is substantially constant and inclined at an angle 73B with respect to the top face of the rail 51 in the direction of travel of each wheel 53 to be braked (arrow F). This accordingly ensures uniform motion of the braking rocker 73 and uniform downward displacement of the associated braking piston 73C (FIGS. 16 and 19) at the time of passage of each wheel 53.

As shown in FIGS. 16 and 17, the pivot-pin 74 of the motion-transmission rockers 71, 72, 73 can be common to the different components, for example, and is advantageously supported by brackets 78 mounted on vertical rigid partitions 79 which are transverse to the braking rail 51. The support brackets 78 are associated for example with detachable cover-plates 78A in order to ensure that the rockers 71, 72 and 73 which are pivotally mounted on the pin 74 are securely and conveniently fixed in position. The partitions 79 are rigidly fixed to a bed-plate 81 mounted on the crossties 3A of the track, for example by means of screw-spikes 82.

Steps are advantageously taken to ensure that the bed-plate 81 has an upwardly curved flange 83 adapted to be applied against the braking rail in the service position of the track brake, for example beneath the rest-position stops 75 which are associated with the various motion-transmission rockers 71, 72, 73 (as shown in FIGS. 16 to 19). The bed-plate 81 is secured to the braking rail 51 on the side corresponding to its flange 83, for example by means of a weld bead 84 (FIGS. 18, 19) so that the plate 81 is securely joined to one flange of the base of the rail 51.

The partitions 79 which are in turn secured to the bed-plate 81 both firmly and in a fluid-tight manner by means of welded joints, for example, constitute together with the plate 81 a strong and leak-tight casing for the mechanisms of the track brake.

NUMERICAL EXAMPLE

In accordance with the arrangements described with reference to FIGS. 16 to 22, a track brake has been produced on an industrial scale for a marshalling yard equipped with standardized tracks for receiving freight cars having wheel diameters within the range of 800 to 1000 millimeters. In the direction contemplated for the application of brake action to the cars (as indicated by the arrow F in FIGS. 16 and 22), the track brake comprises a clearing tappet, a weighing tappet and five braking tappets. Each tappet is constituted by the bearing face 71A, 72A, 73A of a motion-transmission rocker 71, 72, 73 associated with a hydraulic piston 71C, 72C, 73C. All the rockers 71, 72, 73 are of steel and pivotally mounted on a common shaft 74 of ground steel having a diameter of approximately 50 mm. As illustrated in FIGS. 18 to 22, each rocker 71, 72, 73 is mounted on the shaft 74 by means of two retaining-rings 74A of high-strength bronze which are inserted on each side within an axial bore of the rocker and terminate in an annular shoulder forming an abutment against the adjacent support bracket 78.

In the direction of the shaft 74, the clearing-tappet bearing face 71A (shown in FIG. 21) has a length of approximately 90 mm. The weighing-tappet bearing face 72A (shown in FIG. 20) has a length of approximately 190 mm. Each braking-tappet bearing face 73A (shown in FIG. 22) has a total length of approximately 225 mm including approximately 140 mm in the case of that portion which has a constant upward slope in the direction of travel of each wheel 53 to be braked (arrow F).

The support brackets 78 which serve to separate the braking rockers 73 have a width of approximately 100 mm in the direction of the shaft 74, and the parallel axes of the hydraulic braking pistons 73C (shown in FIGS. 16 and 19) are spaced apart at an interval of approximately 265 mm.

The bearing face 71A of the clearing tappet is given a substantially symmetrial convex shape in the direction of the shaft 74 and projects upwards to a distance of the order of 5 mm above the top face of the rail 51 in the rest position of the associated rocker 71 as defined by the stop 75 which is similar to that shown in FIGS. 18 and 19.

The recess 77 of the rail 51 (shown in FIGS. 16 and 20) which is located opposite to the bearing face 72A of the weighing tappet is approximately 10 mm, thereby permitting downward displacement of the same order at maximum load in the case of the aforementioned bearing face of the weighing tappet. The recess 77 is joined to the normal portions of the top face of the rail 51 by means of two uniform ramps which are intended to prevent jumping of the wheel which arrives on the bearing face 72A of the weighing tappet and leaves this latter. The exit ramp is substantially three times as long as the entrance ramp and has an angle of slope which is one-third of the value of this latter in the direction of the arrow F of normal travel of the cars to be braked.

In the case of the bearing face 73A of each weighing tappet (FIGS. 18 and 20), provision has been made for a range of downward displacement of the order of 65 mm with respect to the level of the top face of the rail 51. The substantially constant slope of the corresponding portion of the bearing face 73A has an angle 73B of approximately 20° with respect to the rail 51 (as shown in FIG. 22).

Thus the overall length of all the track-brake tappets is of the order of 2.25 meters along the rail 51 and the total range of brake-application travel of the hydraulic pistons 73C (shown in FIGS. 16 and 19) which can perform a contributory function in retarding a wheel 53 is approximately 320 mm, on the assumption that the radial displacement of each braking-tappet bearing face 73A is substantially the same as that of the boss of the rocker 73 which cooperates with the brake-application piston 73C.

We claim:

1. A railway track brake for limiting the speed of rolling motion of a freight car on an inclined shunting track, said track brake comprising retarding means installed in the service position along a braking rail of the track, the retarding means comprising a number of braking modules each comprising a braking tappet having in the rest position a portion which projects above the level of the top face of the braking rail in order to be successively applied beneath each car wheel, said tappet being connected to a piston-rod of a piston of a hydraulic brake cylinder by means of a motion transmission rocker having a pivot-pin connected to the braking rail, a restoring spring within said piston for urging said tappet toward the rest position thereof, a first end of said rocker acting against said braking tappet and a second end of said rocker acting against said piston rod in a direction transverse to the braking rail, said hydraulic brake cylinder being substantially horizontal, said rocker having on each said end thereof a cup receiving a substantially hemispherical face of a half-ball joint component which is concentric with said cup, a substantially equatorial flat on said half-ball joint component projecting from said cup and bearing respectively against a corresponding flat face of said braking tappet and against a flat face of the associated extremity of said piston-rod of said horizontal hydraulic cylinder.

2. A track brake according to claim 1, wherein the braking tappet comprises a horseshoe body having two substantially parallel arms slidably mounted in guides rigidly fixed to the braking rail, a profiled top portion of the tappet body which joins the two arms to each other projecting above the level of the top face of the braking rail when said tappet is in the rest position.

3. A track brake according to claim 2, wherein the flat face of the tappet associated with the substantially equatorial face of the corresponding half-ball joint component is located between the substantially parallel arms of said tappet beneath the profiled top portion and substantially at the center of said top portion.

4. A track brake according to claim 2, wherein the profiled top portion of each braking tappet has a substantially constant slope in the direction of travel of the freight car to be braked in order to ensure uniform downward displacement of the said tappet at the time of passage of each car wheel.

5. A track brake according to claim 4 wherein the guides rigidly fixed to the braking rail are substantially at right angles to the constant-slope bearing face of the braking tappet, the pivot-pin of the motion-transmission rocker associated with the braking tappet being substantially parallel to said bearing face.

6. A railway track brake for limiting the speed of rolling motion of a freight car on an inclined shunting track, comprising at least one braking tappet and a hydraulic brake cylinder which is caused to operate by throttling of a fluid, and means for adjusting said throttling on demand according to the weight carried by each car, the adjusting means comprising a brake-application regulator having a throttling piston subjected to the action of an opposing spring controlled by a wheel-weighing tappet, said weighing tappet being disposed before the first braking tappet in the intended direction of travel of the car to be braked, said regulator being mounted in a hydraulic circuit for discharge from brake cylinders each acting against one of the braking tappets in order to adjust the throttling action of the fluid of each cylinder according to the weight of each wheel as measured by said weighing tappet, a weighing hydraulic cylinder fitted with a piston and with a piston-rod connected to the weighing tappet to control the brake application regulator, said weighing tappet and said weighing hydraulic cylinder being respectively interchangeable with the braking tappets and with the braking hydraulic cylinders.

7. A railway track brake for limiting the speed of rolling motion of a freight car on an inclined shunting track, comprising a hydraulic brake cylinder which is caused to operate by throttling of a fluid, at least one braking tappet to actuate said brake cylinder, and means for adjusting said throttling on demand according to the weight carried by each car, the adjusting means comprising a brake-application regulator having a throttling piston that acts against an opposing spring controlled by a wheel-weighing tappet, said weighing tappet being disposed before the first braking tappet in the intended direction of travel of the car to be braked, said regulator being mounted in a hydraulic circuit for discharge from brake cylinders each connected to one of the braking tappets in order to adjust the throttling action of the fluid of each cylinder according to the weight of each wheel as measured by said weighing tappet, said brake-application regulator comprising a clearing device for producing the expansion of the opposing spring compressed by the weighing tappet, said clearing device of the regulator being controlled by means of a clearing hydraulic cylinder fitted with a piston and with a piston-rod associated with a clearing tappet which is disposed after the last braking tappet in said direction of travel of the wheel to be braked, and reversal means whereby a car is permitted to travel back along the track in the direction opposite to the direction of normal braking without any brake application and without any danger of incidents, said reversal means comprising a complementary clearing device for causing expansion of the opposing spring compressed by the weighing tappet after said car has passed in the opposite direction.

8. A railway track brake for limiting the speed of rolling motion of a freight car on an inclined shunting track, said track brake comprising retarding means installed in the service position along a braking rail of the track, the retarding means comprising a number of braking modules each comprising a braking tappet, each tappet having in the rest position a portion which projects above the level of the top face of the braking rail in order to be successively applied beneath each car wheel, said tappet being connected to a piston-rod of a piston of a hydraulic brake cylinder by means of a motion-transmission rocker having a pivot-pin connected to the braking rail, a restoring spring being within said piston urging said tappet toward the rest position thereof, said rocker being integral with said braking tappet, an end of said rocker acting in a direction transverse to the braking rail against said piston-rod, said hydraulic brake cylinder being substantially horizontal, a wheel-weighing tappet controlling a regulator connected with each braking hydraulic cylinder, the bearing face of the radial projection of the rocker which constitutes the weighing tappet being substantially flat and parallel to the top portion of the adjacent rail and to the pivot-pin of said rocker, the top portion of the braking rail located opposite to the radial projection of the weighing rocker having a profiled recess below the level of the top face of the remainder of the braking rail, the substantially flat bearing face of the weighing rocker being located at the same height as said level in the rest position.

* * * * *